US008602733B2

(12) United States Patent
Christofi et al.

(10) Patent No.: US 8,602,733 B2
(45) Date of Patent: Dec. 10, 2013

(54) STRUCTURAL AND ACOUSTICAL VIBRATION DAMPENER FOR A ROTATABLE BLADE

(75) Inventors: Costas Christofi, Flint, TX (US); Quynh Hoang, Tyler, TX (US); Sanjay Gupta, Tyler, TX (US); Angus Lemon, Tyler, TX (US); James T. Vershaw, Tyler, TX (US); Nandagopal Nalla, Tyler, TX (US); Emile Abi-Habib, Tyler, TX (US)

(73) Assignee: Trane International, Inc., Piscataway, NJ (US)

( * ) Notice: Subject to any disclaimer, the term of this patent is extended or adjusted under 35 U.S.C. 154(b) by 1021 days.

(21) Appl. No.: 12/163,397

(22) Filed: Jun. 27, 2008

(65) Prior Publication Data

US 2009/0324418 A1 Dec. 31, 2009

(51) Int. Cl.

| | |
|---|---|
| ***F03B 7/00*** | (2006.01) |
| ***F03D 11/02*** | (2006.01) |
| ***F04D 29/38*** | (2006.01) |
| ***F01D 5/20*** | (2006.01) |
| ***F01D 5/08*** | (2006.01) |
| ***F01D 5/14*** | (2006.01) |
| ***B63H 7/02*** | (2006.01) |

(52) U.S. Cl.
USPC ..... 416/97 R; 416/224; 416/241 R

(58) Field of Classification Search
USPC ..... 416/224
See application file for complete search history.

(56) References Cited

U.S. PATENT DOCUMENTS

| | | | | |
|---|---|---|---|---|
| 2,425,088 | A | 8/1947 | Dean | |
| 3,373,930 | A | 3/1968 | Rom | |
| 3,773,435 | A | 11/1973 | Wooden | |
| 5,141,400 | A | 8/1992 | Murphy et al. | |
| 5,486,096 | A | 1/1996 | Hertel et al. | |
| 5,725,355 | A | 3/1998 | Crall et al. | |
| 6,287,664 | B1 | 9/2001 | Pratt | |
| 6,669,447 | B2 * | 12/2003 | Norris et al. | 416/224 |
| 6,712,584 | B2 | 3/2004 | Zeng | |
| 6,814,545 | B2 | 11/2004 | Hext, III et al. | |
| 2009/0142193 | A1 * | 6/2009 | Bech | 416/144 |
| 2009/0297359 | A1 * | 12/2009 | Shah et al. | 416/241 R |
| 2009/0317236 | A1 * | 12/2009 | Hardwicke | 415/119 |

OTHER PUBLICATIONS

Christofi, Costas; U.S. Appl. No. 12/169,194; Title "Acoustical Vibration Dampener for a Rotatable Blade"; Filing Date: Jul. 8, 2008; Specification 14 pages; 4 Drawing Sheets (Figs. 1A-1B, 2A-2B, 3).

* cited by examiner

*Primary Examiner* — Fernando L Toledo
*Assistant Examiner* — Valerie N Newton
(74) *Attorney, Agent, or Firm* — Conley Rose, P.C.; J. Robert Brown, Jr.; Alan Dawson Lightfoot

(57) ABSTRACT

A structural and acoustical vibration dampener for a rotatable blade comprises a layer of structural/acoustic damping material coupled to at least a portion of the blade. A fan blade comprises a structural layer and a layer of damping material coupled to at least a portion of the structural layer. A method of applying a structural and acoustical vibration dampener to a fan blade comprises identifying a region on the fan blade and securing the structural/acoustical vibration dampener to the fan blade over at least a portion of the region.

24 Claims, 6 Drawing Sheets

STRUCTURAL AND ACOUSTICAL VIBRATION DAMPENER FOR A ROTATABLE BLADE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

A typical fan includes a cylindrical hub body with a rotatable blade assembly coupled thereto. The rotatable blade assembly includes a spider with a plurality of arms extending outwardly from a cylindrical central portion connected to the hub body and a plurality of rotatable blades attached to the spider arms. One end of a cylindrical rod, or driveshaft, is disposed within an axial bore through the hub and coupled to the hub body using a set screw or other connection device. A drive unit, such as an electric motor, is coupled to the other end of the driveshaft and operates to transfer power to the hub body in the form of torque by rotating the driveshaft. Due to the coupling of the driveshaft to the hub, and the hub to the blade assembly, rotation of the driveshaft imparts rotation to the hub body and the blades.

Fans are employed in a wide variety of applications and industries, but common design criteria related to fan efficiency and noise requirements, for example, may be employed in many such applications.

SUMMARY OF THE DISCLOSURE

A structural and acoustical vibration dampener for a rotatable blade is disclosed. In an example embodiment, a structural/acoustical vibration dampener for a rotatable blade is disclosed with a layer of structural/acoustic damping material coupled to at least a portion of the blade.

In a second example embodiment, a fan blade is disclosed with a structural layer, and a layer of damping material coupled to at least a portion of the structural layer.

In a third example embodiment, a method of applying a structural/acoustical vibration dampener to a fan blade is disclosed. The method identifies a region on the fan blade, and secures the structural/acoustical vibration dampener to the fan blade over at least a portion of the region.

Thus, the structural/acoustical vibration dampener and associated methods comprise a number of features. The various characteristics described above, as well as other features, will be readily apparent to those skilled in the art upon reading the following detailed description of the embodiments of the disclosure, and by referring to the accompanying drawings.

BRIEF DESCRIPTION OF THE DRAWINGS

For a more detailed description of the various embodiments of the structural and acoustical vibration dampener for a rotatable blade, reference will now be made to the accompanying drawings, wherein.

DETAILED DESCRIPTION

Figure 1A:
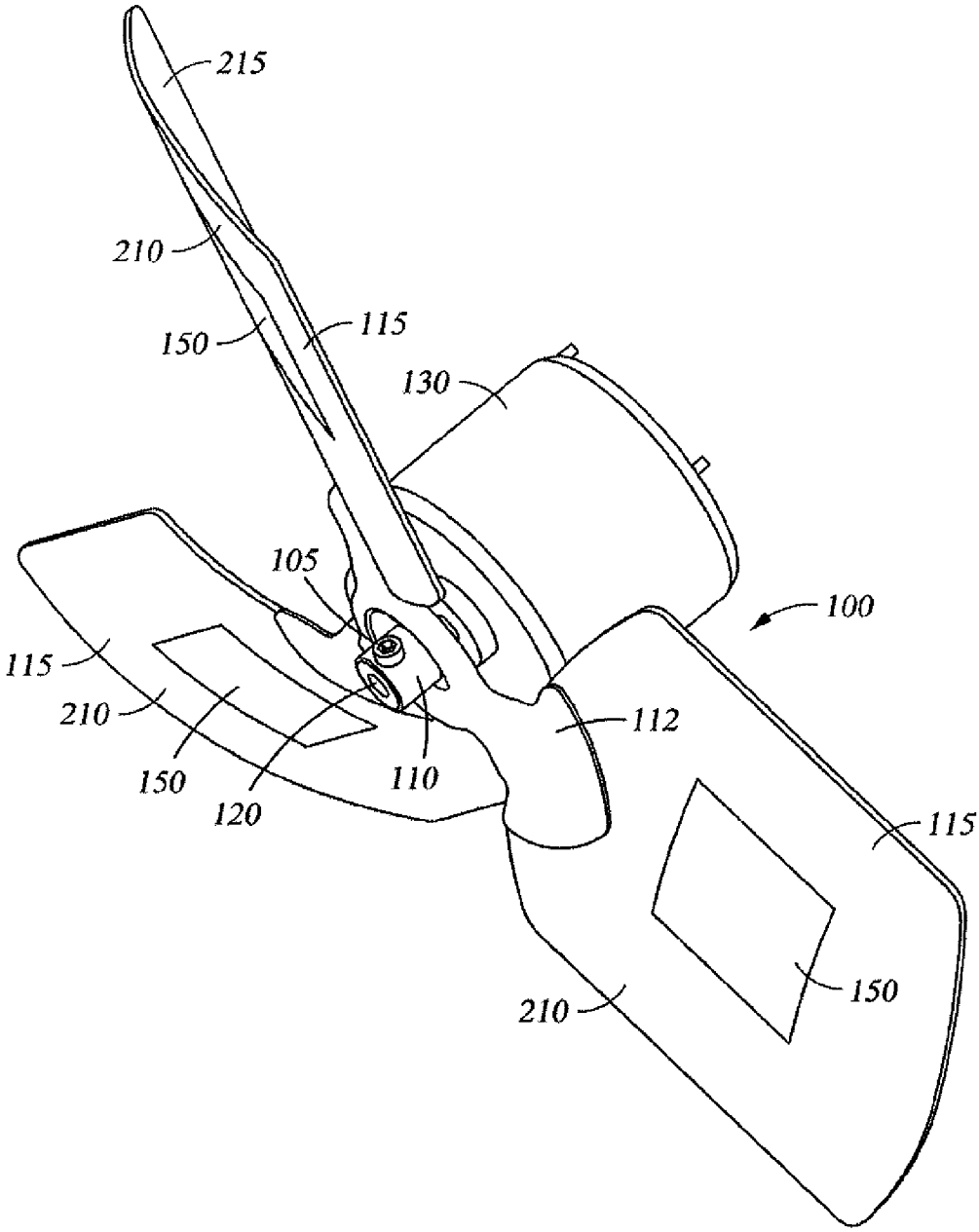
FIG. 1A is a schematic perspective view of a fan assembly comprising a representative embodiment of a rotatable blade incorporating a structural/acoustical vibration dampener in accordance with the principles disclosed herein.

Dynamic systems comprise at least three basic characteristics: mass, stiffness and damping. Real structures have distributed mass, stiffness and damping. Hence, real structures have multiple degrees of freedom. When real structures are attached to rotating machinery, such as an electric motor, for example, their vibration and acoustic response will depend on the distribution of their dynamic characteristics and how they interface with the excitation force exerted by the rotating machinery. Without sufficient damping, such an excitation force may cause cyclic deformation of the attached real structure.

During operation of a fan assembly, for example, the rotating drive unit vibrates, in part due to external loads and any imbalances in the motor itself, and this vibration is transferred via an excitation force to the blades through the driveshaft, hub and other components of the fan assembly. This excitation force may cause the blades to vibrate, and any imbalances in the blade assembly may also contribute to blade vibration. Over time, such vibration and the resulting cyclic deformation may shorten the blade life due to the effects of fatigue. Moreover, vibration of the blade assembly and motor may result in acoustic or sound radiation, producing undesirable audible noise that exceeds acceptable levels.

As the frequency of the excitation force approaches any of the natural or resonance frequencies of the blades, vibration of the blades may be amplified, even though the magnitude of the excitation force may not have changed. When the frequency of the excitation force coincides with a natural frequency of the blades, vibration of the blades is maximized. Thus, the blades experience maximum deformation and produce the highest level of acoustic or sound radiation, often resulting in undesirable levels of audible noise. The deformed shape of a blade responding to application of an excitation force at a frequency equal to a natural frequency of the blade is often referred to as its mode shape. When a blade deforms to one of its mode shapes, the blade may experience complete structural failure.

Some methods of reducing vibration, and the associated fatigue and noise, in a fan assembly are to equip the electric motor with a vibration dampener and/or eliminate imbalances in the motor through maintenance and/or offset imbalances in the blade assembly by coupling small weights to one or more of the blades, as is often done to balance residential ceiling fans. Alternatively, the blade structure may be modified to cause a shift in the natural frequencies of the blades away from the frequency of the motor excitation force, such as by viscous dampening, which involves changing the weight or stiffness of the blade. However, these methods may not adequately dampen or reduce fan vibration, and the associated noise, in certain circumstances.

For example, if a drive unit is a variable speed motor without a vibration dampener, then more than one of its variable speeds may produce an excitation force having a frequency equal to a natural frequency of the blades. Such speeds are referred to as critical speeds, and a variable speed motor in a fan assembly may have multiple critical speeds. Thus, it may not be possible to modify the blade structures by viscous dampening so as to shift their natural frequencies sufficiently away from the excitation frequencies of the motor for all of the critical speeds.

The present disclosure relates generally to apparatus and methods for damping vibration of a rotatable blade. More particularly, the present disclosure relates to a structural and acoustical vibration dampener for a rotatable blade, which is susceptible to embodiments of different forms. There are shown in the drawings, and herein will be described in detail, specific embodiments of a structural/acoustical vibration dampener for a rotatable blade and associated methods with the understanding that the disclosure is to be considered representative only and is not intended to limit the apparatus and methods to that illustrated and described herein. In particular, various embodiments of the structural/acoustical vibration dampener are described in the context of a fan blade. However, these components may be used in any application where it is desired to reduce vibration of a rotating blade and the associated audible noise. Thus, a structural/acoustical vibration dampener for a rotatable blade may be utilized in, for example, a turbine or an airboat, as well as a fan. It is to be fully recognized that the different teachings of the embodiments disclosed herein may be employed separately or in any suitable combination to produce desired results.

Figure 1B:
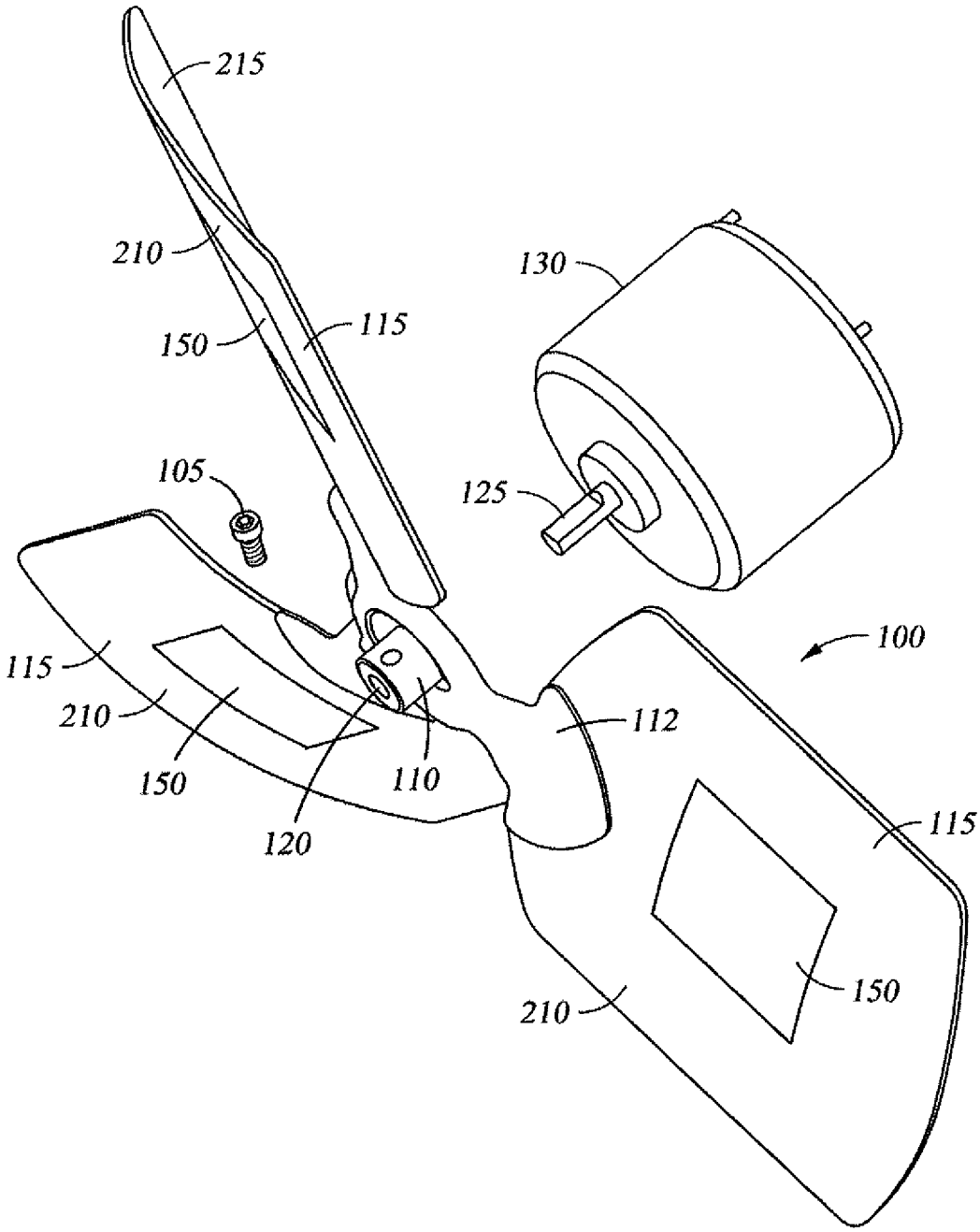
FIG. 1B is a schematic perspective view of the fan assembly of FIG. 1A, partially separated to depict its various components.

FIGS. 1A and 1B depict schematic perspective views of a fan 100 in assembled and partially disassembled form, respectively; the fan 100 comprising a plurality of blades 115, where each is a representative embodiment of a fan blade 115 with sides 210, 215 and with a structural and acoustical vibration dampener 150 affixed to at least one side 210, 215 thereof. Blades 115 are coupled to a hub 110 by a spider 112. Hub 110 has an axial bore 120 therethrough, and a driveshaft 125 disposed partially within the axial bore 120 and coupled to the hub 110 by a set screw 105. Fan 100 further comprises a drive unit 130 coupled to the driveshaft 125 and selectively operable to rotate the driveshaft 125. Drive unit 130 may comprise an electric motor or another type of motor, for example. In at least one embodiment, drive unit 130 is a variable speed electric rotor motor without a resilient vibration isolator, also referred to as a non-resilient rotor mount. Due to the coupling of the driveshaft 125 and hub 110 via the set screw 105, rotation of the driveshaft 125 by the drive unit 130 also causes rotation of the hub 110, the spider 112 and the blades 115, thereby creating movement of the surrounding air.

Figure 2A:
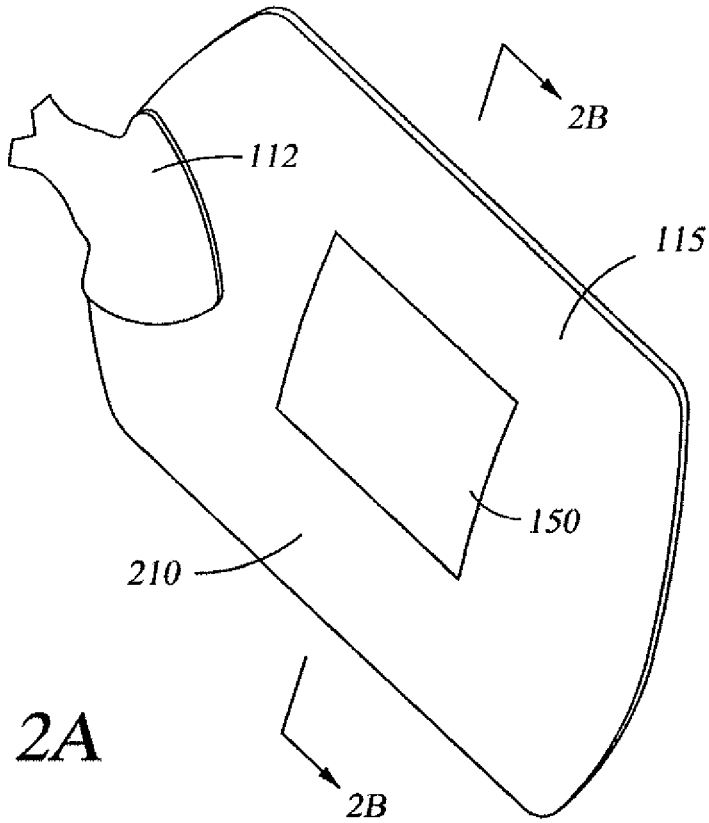
FIG. 2A is a schematic perspective view of a representative embodiment of a rotatable fan blade with a structural/acoustical vibration dampener.
Figure 2B:
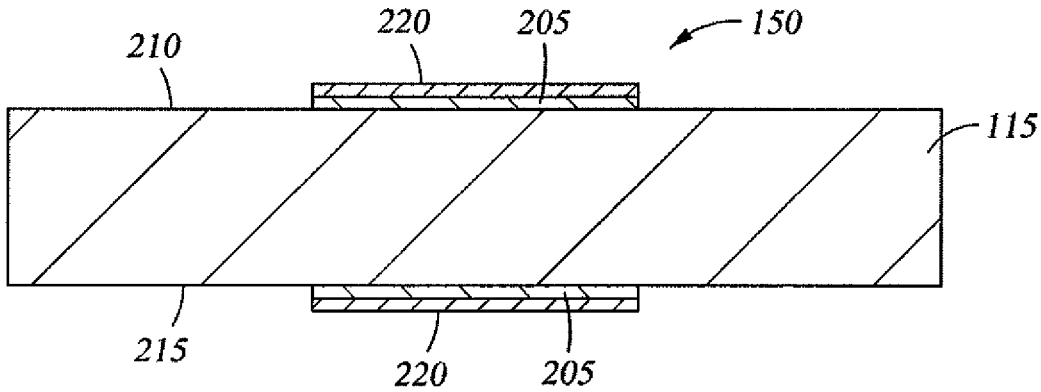
FIG. 2B is a schematic cross-sectional view of the fan blade of FIG. 2A taken along section line 2B-2B.

FIGS. 2A and 2B are schematic perspective and cross-sectional views, respectively, of a single blade 115 with structural/acoustical vibration dampener 150 affixed thereto. Blade 115 may comprise a conventional fan blade formed of any suitable material, such as aluminum, steel, other metals, or plastics. Structural/acoustical vibration dampener 150 may cover only a portion of blade 115, as shown in FIG. 2A, on either or both sides 210, 215 of blade 115, as shown in FIG. 2B. Alternatively, structural/acoustical vibration dampener 150 may extend the full length and width of blade 115, again on either or both sides 210, 215 of blade 115. Further, the size and orientation of structural/acoustical vibration dampener 150 may vary from one blade 115 to another within fan 100. Still further, each blade 115 may comprise more than one structural/acoustical vibration dampener 150.

As illustrated by FIG. 2B, in an embodiment, structural/acoustical vibration dampener 150 comprises a layer of structural and acoustic damping material 205, shown coupled to each side 210, 215 of blade 115. Structural/acoustic damping material 205 comprises a vibration damping, or energy absorbing, material, and in some embodiments may comprise an adhesive, a resin, an epoxy, a glue, a tape or a paint that may be directly applied to sides 210, 215 of blade 115 without the need for a separate bonding material. Further, structural/acoustic damping material 205 may comprise viscoelastic material. A suitable viscoelastic damping material is available from MSC. In an embodiment, the structural/acoustic damping material 205 cures over time at ambient temperature or in response to the application of heat.

Structural/acoustical vibration dampener 150 may optionally further comprise a protective layer 220 of material, such as foil or other suitable material, that overlies the structural/acoustic damping material 205. In some embodiments where the protective layer 220 comprises foil, the foil is aluminum. If the structural/acoustic damping material 205 has a pressure sensitive, adhesive property, protective layer 220 may adhere directly to structural/acoustic damping material 205 without the need for glue or another similar bonding material. In an embodiment, the structural/acoustic vibration dampener 150 is a specially formulated pressure sensitive, adhesive (PSA) foil-tape consisting of a structural/acoustic damping material 205 overlaid by a foil protective layer 220. One suitable PSA foil tape is Avery Denison FT0816, and suitable PSA tapes are also available from 3M and other suppliers.

The size and positioning of each structural/acoustical vibration dampener 150 on a blade 115 is dictated by the degree of damping needed, or desired, during operation of fan 100. Notably, a suitable, but coarse, damping technique is to extend structural/acoustical vibration dampener 150 the full length and width of blade 115. However, to determine more particularly the degree of damping needed, the natural or resonance frequencies and their corresponding mode shapes for blade 115, in the absence of any structural/acoustical vibration dampener 150, are first identified, either through testing or through experimental or analytical modal analysis. A mode shape, also known as a deflection shape, is the deformed shape of blade 115 resulting from the application of an excitation force, such as that provided by motor vibration, at a frequency equal to a corresponding natural frequency. Blade 115 may have one or more natural frequencies and a mode shape corresponding to each. By identifying and examining each mode shape of blade 115, the location(s) of maximum vibration, or maximum deflection, for blade 115 may be identified. In the locations of maximum vibration, a portion of blade 115 deflects in a first direction and an adjacent portion of blade 115 approximately simultaneously deflects in a second direction that is opposite and out of phase with the first direction. For example, in one representative location of maximum deflection, a portion of blade 115 may deflect upwardly while an adjacent portion of blade 115 approximately simultaneously deflects downwardly relative to a horizontal plane.

Once identified, a structural/acoustical vibration dampener 150 may be positioned at each of these maximum deflection locations to overlap adjacent portions of the blade 115 that vibrate or deform out of phase with one another. In other words, each structural/acoustical vibration dampener 150 so positioned couples a region of high blade vibration in a first direction to a region of high blade vibration in a second direction that is out of phase with the first direction, thereby providing damping to the region. By positioning structural/acoustical vibration damnpener(s) 150 in this manner, maximum blade vibration, and thus deformation, is reduced by the energy-absorbing ability of structural/acoustic damping material 205. Hence, during operation of fan 100, the magnitude of vibrations experienced by blade 115 is reduced. Accordingly, the magnitude of sound pressure waves produced by the blade vibrations is also reduced, yielding a reduction in the level of noise generated by the vibration of blade 115, and therefore fan 100.

Figure 3A:
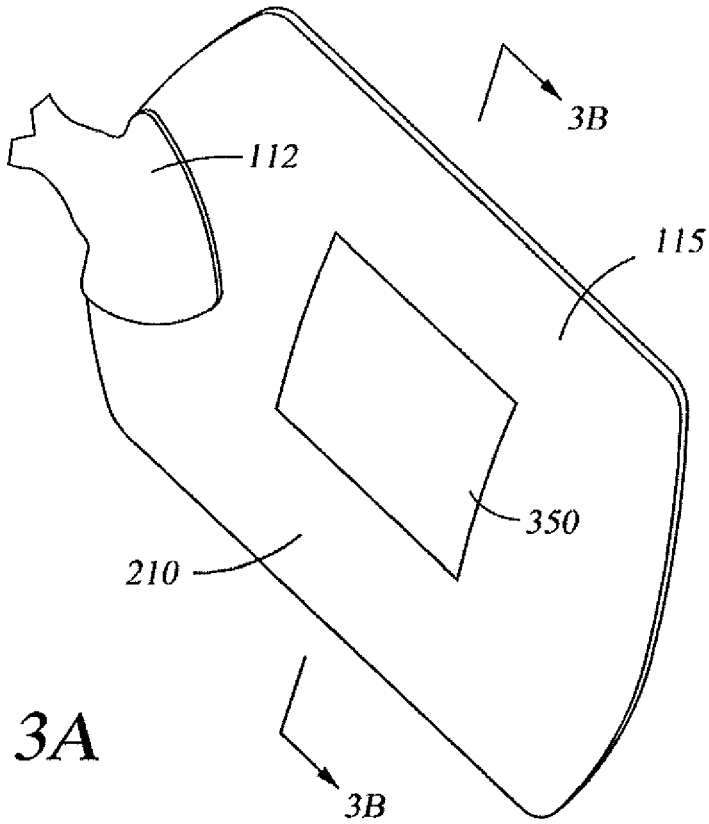
FIG. 3A is a schematic perspective view of another representative embodiment of a rotatable fan blade with a structural/acoustical vibration dampener.
Figure 3B:
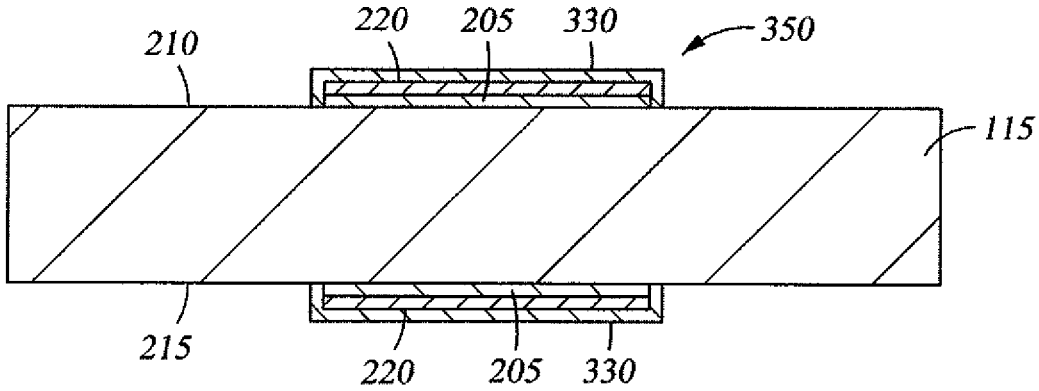
FIG. 3B is a schematic cross-sectional view of the fan blade of FIG. 3A taken along section line 3B-3B.

FIGS. 3A and 3B are schematic perspective and cross-sectional views, respectively, of another representative fan blade 115 with a structural/acoustical vibration dampener 350. Structural/acoustical vibration dampener 350 may be similar in all respects to structural/acoustical vibration dampener 150 except that structural/acoustical vibration dampener 350 further comprises a laminate layer 330 disposed over each protective layer 220 to provide additional protection to both protective layer 220 and the underlying structural/acoustic damping material 205 from the surrounding environment. In some embodiments, laminate layer 330 comprises plastic.

Figure 4A:
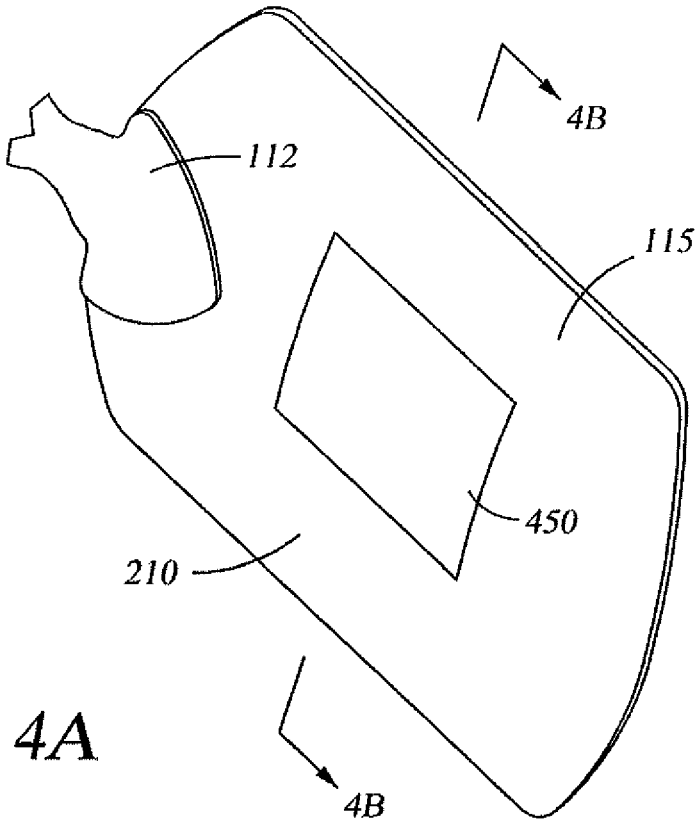
FIG. 4A is a schematic perspective view of yet another representative embodiment of a rotatable fan blade with a structural/acoustical vibration dampener.
Figure 4B:
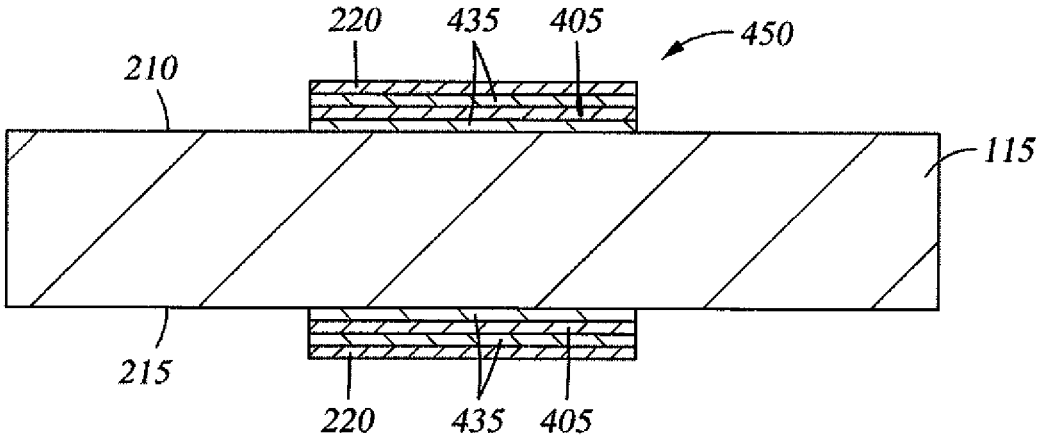
FIG. 4B is a schematic cross-sectional view of the fan blade of FIG. 4A taken along section line 4B-4B.

FIGS. 4A and 4B are schematic perspective and cross-sectional views, respectively, of another representative fan blade 115 with a structural and acoustical vibration dampener 450. Structural/acoustical vibration dampener 450 may be similar in all respects to structural/acoustical vibration dampener 150 except that structural/acoustic damping material 405 does not comprise an adhesive property. As such, glue, tape or other similar bonding material 435 may be applied between sides 210, 215 of blade 115 and the adjacent layers of structural/acoustic damping material 405 and between the layers of structural/acoustic damping material 405 and the adjacent protective layers 220 to affix all layers of the structural/acoustical vibration dampener 450 to blade 115. As described above in reference to structural/acoustical vibration dampener 350 and shown in FIG. 3B, structural/acoustical vibration dampener 450 may optionally further comprise a laminate layer 330 over protective layer 220.

Figure 5:
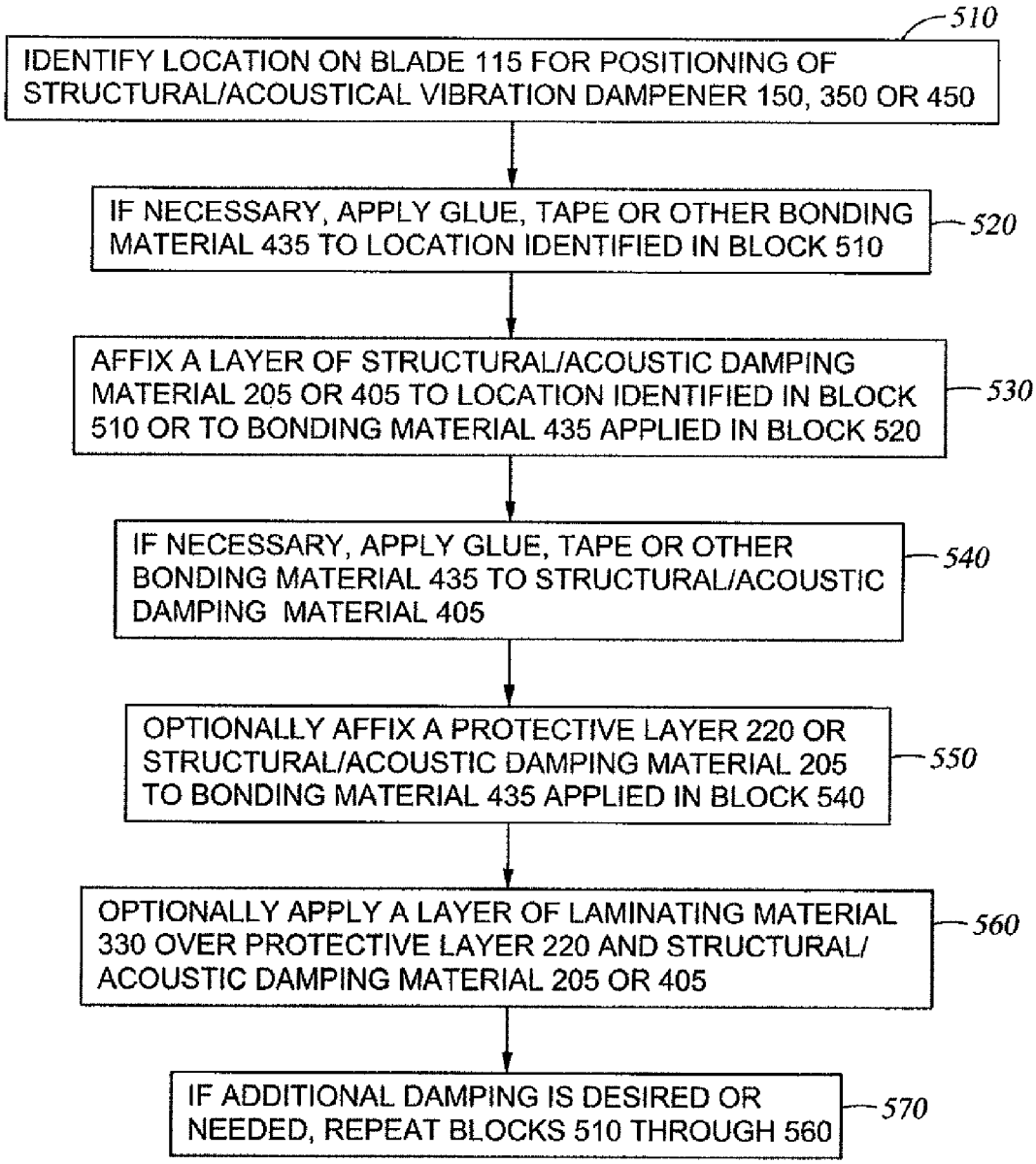
FIG. 5 is a flowchart of one representative method for constructing a rotatable fan blade with a structural/acoustical vibration dampener.

FIG. 5 illustrates one embodiment of a method for constructing a fan blade 115 with a structural/acoustical vibration dampener 150, 350, or 450. The method begins at block 510 by identifying a location on blade 115 where a structural/acoustical vibration dampener 150, 350 or 450 may be applied to reduce blade vibration. As described above, the mode shape for each natural frequency of blade 115, in the absence of any structural/acoustical vibration dampener 150, 350 or 450, is identified through testing or analysis and examined to determine the region(s) of maximum blade vibration, or deformation. These regions suggest the most effective locations for placement of structural/acoustical vibration dampener(s) 150, 350 or 450 for the purpose of noise reduction. For a region of maximum blade deformation identified through testing or analysis, the location on blade 115 for placement of structural/acoustical vibration dampener(s) 150, 350 or 450 is such that structural/acoustical vibration dampener 150, 350 or 450, when coupled to blade 115, overlaps adjacent portions of the blade 115 that vibrate or deform out of phase with one another.

At block 520, glue, tape or other bonding material 435 may be applied to the location identified in block 510 if the structural/acoustical vibration dampener comprises a structural acoustic damping material that does not have an adhesive property, such as structural/acoustical vibration dampener 450. Next, at block 530, a layer of structural/acoustic damping material 205 or 405 is applied to the location identified in block 510 or to the bonding material 435 of block 520, respectively, by application of pressure. Once applied, structural/acoustic damping material 205 or 405 ties or couples adjacent portions of the blade 115 that vibrate or deform out of phase with one another. If necessary, glue, tape or other bonding material 435 is applied to structural/acoustic damping material 405 of structural/acoustical vibration dampener 450 at block 540. A protective layer 220 of foil or other suitable material may optionally be overlaid onto structural/acoustic damping material 205 or bonding material 435 covering structural/acoustic damping material 405 by application of pressure at block 550. Lastly, a layer of laminating material 330 may be optionally applied over protective layer 220 and structural/acoustic damping material 205 or 405. The method is repeated as necessary to achieve the desired degree of damping for blade 115.

A structural/acoustical vibration dampener in accordance with the principles disclosed herein should diminish the magnitude of vibrations that a fan blade would otherwise experience in the absence of the structural/acoustical vibration dampener. As a result, the magnitude of sound pressure waves produced by the blade vibrations should also be reduced, which would thereby reduce the level of noise produced by the blades. In addition to noise reduction, the effects of fatigue to the blade would also be reduced, providing a longer service life for the fan.

While various embodiments of a structural/acoustical vibration dampener and methods of constructing a rotatable blade with a structural/acoustical vibration dampener have been shown and described, modifications thereof can be made by one skilled in the art without departing from the spirit or teaching of this disclosure. The embodiments described herein are representative only and are not limiting. Many variations and modifications of the apparatus and methods are possible and are within the scope of the disclosure. Accordingly, the scope of protection is not limited to the embodiments described herein, but is only limited by the claims which follow, the scope of which shall include all equivalents of the subject matter of the claims.

What is claimed is:

1. A structural/acoustical vibration dampener for a rotatable blade comprising:

a layer of structural/acoustic damping material disposed on a single external surface of the blade, wherein the structural/acoustic damping material covers at least a portion of the external surface of the blade;

wherein the structural/acoustic damping material comprises a viscoelastic material.

2. The structural/acoustical vibration dampener of claim 1, further comprising:

a layer of protective material overlaying the structural/acoustic damping material such that the structural/acoustical damping material is disposed between the layer of protective material and the external surface.

3. The structural/acoustical vibration dampener of claim 1, wherein the structural/acoustic damping material comprises an adhesive property.

4. The structural/acoustical vibration dampener of claim 1, wherein the structural acoustic damping material comprises paint.

5. The structural/acoustical vibration dampener of claim 1, wherein the structural/acoustic damping material cures at ambient temperature.

6. The structural/acoustical vibration dampener of claim 1, wherein the structural/acoustic damping material cures in response to the application of heat.

7. The structural/acoustical vibration dampener of claim 2, wherein the structural/acoustical vibration dampener comprises tape.

8. The structural/acoustical vibration dampener of claim 2, wherein the protective material is foil.

9. The structural/acoustical vibration dampener of claim 8, wherein the foil is aluminum.

10. The structural/acoustical vibration dampener of claim 2, further comprising a laminate layer overlaying the layer of protective material.

11. The structural/acoustical vibration dampener of claim 10, wherein the laminate layer comprises plastic.

12. A fan blade comprising:

a structural layer defining at least a bottom side and a top side of the fan blade; and a layer of viscoelastic damping material coupled to the structural layer, wherein the damping material is disposed on at least a portion of a single external surface of the bottom or top side of the fan blade.

13. The fan blade of claim 12, further comprising:

a layer of protective material;

wherein the layer of damping material is disposed between the structural layer and the layer of protective material.

14. The fan blade of claim 12, wherein the layer of damping material directly adheres to the structural layer.

15. The fan blade of claim 13, wherein the layer of damping material directly adheres to the layer of protective material.

16. The fan blade of claim 13, further comprising a laminate layer overlaying the layer of protective material such that the layer of protective material is disposed between the laminate layer and the layer of damping material.

17. A method of applying a structural/acoustical vibration dampener to a fan blade, comprising:

identifying a region on the fan blade; and securing the structural/acoustical vibration dampener to a single external surface of the fan blade such that the structural/acoustical vibration dampener extends over at least a portion of the region;

wherein the structural/acoustic damping material comprises a viscoelastic material.

18. The method of claim 17, wherein the identifying comprises:

determining one or more natural frequencies of vibration of the fan blade;

determining a mode shape corresponding to each natural frequency; and selecting an area of maximum vibration on the fan blade for at least one mode shape as the region.

19. The method of claim 17, wherein the structural/acoustical vibration dampener comprises a layer of structural/acoustic damping material and a layer of protective material; and wherein the securing comprises:

adhering the layer of structural/acoustic damping material to the external surface of the fan blade; and adhering the layer of protective material to the layer of structural/acoustic damping material such that the structural/acoustic damping material is disposed between the layer of protective material and the external surface of the fan blade.

20. The method of claim 17, further comprising laminating the structural/acoustical vibration dampener.

21. The method of claim 17, wherein the region on the fan blade experiences at least some deformation and wherein the securing of the structural/acoustical vibration dampener to the fan blade further comprises coupling adjacent portions of the fan blade that deform out of phase with one another.

22. The structural/acoustical vibration dampener of claim 1, wherein the structural/acoustic damping material extends along the external surface for the full length and width of the blade.

23. The structural/acoustical vibration dampener of claim 1, further comprising:

another layer of structural/acoustic damping material disposed on an opposing external surface of the blade such that the blade is disposed between each layer of structural/acoustic damping material.

24. The structural/acoustical vibration dampener of claim 10, wherein the laminate layer surrounds the layer of protective material and the layer of structural/acoustic damping material such that the protective material and the structural/acoustic damping material are enclosed within an interior formed between the laminate layer and the external surface.

* * * * *